United States Patent [19]

Miyazaki et al.

[11] 4,211,052

[45] Jul. 8, 1980

[54] PACKAGING PAPER CONFIRMING DEVICE IN A COIN PACKAGING MACHINE

[75] Inventors: Yorizo Miyazaki; Hideshi Sentoku; Katusuke Furuya, all of Tokyo, Japan

[73] Assignee: Laurel Bank Machine Co., Ltd., Tokyo, Japan

[21] Appl. No.: 21,703

[22] Filed: Mar. 19, 1979

[30] Foreign Application Priority Data

Mar. 23, 1978 [JP] Japan ..... 53-33325

[51] Int. Cl.[2] ..... B65B 57/00; B65B 11/04

[52] U.S. Cl. ..... 53/77; 53/212

[58] Field of Search ..... 53/77, 212

[56] References Cited

U.S. PATENT DOCUMENTS

| | | | |
|---|---|---|---|
| 3,950,921 | 4/1976 | Itoda et al. | 53/212 X |
| 4,085,879 | 4/1978 | Nobuhiro | 53/212 X |

*Primary Examiner*—Travis S. McGehee

*Attorney, Agent, or Firm*—Fleit & Jacobson

[57] ABSTRACT

A coin packaging machine in which different kinds of coins are packaged is provided. The coin packaging machine is provided with means for supplying coins, means for transporting the supplied coins while selecting the desired kind of coins during transportation, means for accumulating transported coins, delivery means for receiving accumulated coins and delivering the coins from a receiving position to a packaging position, means for supplying a web of paper within packaging zone and means for clamping the packaged coins. The coin packaging machine includes means for making various adjustments of the above means in accordance with the thickness and the width of the coins to be packaged. The coin packaging machine is also provided with a packaging paper confirming device which functions to remind the operator to change the packaging paper when made necessary by a change in the kind of coin being packaged.

1 Claim, 4 Drawing Figures

PACKAGING PAPER CONFIRMING DEVICE IN A COIN PACKAGING MACHINE

BACKGROUND OF THE INVENTION

The present invention relates to a coin packaging machine in which the peripheries of a predetermined number of accumulated coins are wrapped with a packaging paper and both the upper and lower edges of the packaging paper are inwardly bent by a pair of clamping claws to complete the packaging operation.

In a conventional coin packaging machine of this type, in order to wrap a packaging paper about a predetermined number of coin and inwardly bend the upper and lower edges of the packaging paper in accordance with the thickness of the coins to be packaged, a suitable kind of packaging paper having a suitable width for the thickness of the coins to be packaged must be selected. Otherwise, a good clamping condition cannot be obtained due to the surplus or deficiency of the clamping clamped portions of the packaging paper. There is known a coin packaging machine of the type in which various kinds of packaging papers are automatically selected. Such a machine requires a number of packaging paper charging tables or stands and a driving mechanism for driving the tables to place a suitable table in the paper feeding position and the provision of these charging table and their driving mechanism greatly increases the size of the macine. Therefore, in general coin packaging machines of the type in which the packaging papers are changed when a new type of coin is to be wrapped are usually used. In such machines, the charging table is pulled out of the machine to change the packaging paper and the paper must be changed for each new kind of coin. However, the operator often forgets to check whether the machine is loaded with the right type of packaging paper. As a result, the coin are often wrapped in a packaging paper which is not compatible with the coins.

SUMMARY OF THE INVENTION

It is, therefore, an object of the present invention to provide a packaging paper confirming device for use in a coin packaging machine which eliminates the above-mentioned disadvantages.

It is another object of the invention to provide a packaging paper confirming device of the above type in which the coin packaging machine cannot be started unless the charging table is pulled out and charged with the packaging paper suitable for the coins to be packaged.

In accordance with the present invention, there is provided a packaging paper confirming device in a coin packaging machine which comprises a group of selection switches provided on a coin kind setting mechanism selectable by a coin kind setting operation in accordance with the kind of coin to be packaged, a group of setting switches provided on an adjustment mechanism set at a predetermined angle of rotation in accordance with relation between the selection switches and the setting switches and a packaging paper switch (a near end switch) operable by the mounting and the removing of a removable charging stand, and in which non-conformity signal is produced from the selection of the selection switches and the setting of the setting switches put into and stored in a memory to indicate the non-conformity of the packaging paper and to disenable the operation of the machine, and the memory is reset through the packaging paper switch by the inspection of the packaging paper attendent on the removing and mounting of the charging stand to eliminate the non-conformity signal and to enable the operation of the machine.

DESCRIPTION OF THE DRAWINGS

The present invention will now be described in detail by reference to embodiments illustrated in the accompanying drawings.

DESCRIPTION OF THE PREFERRED EMBODIMENT

One embodiment of the present invention will be now described in detail with reference to the accompanying drawings.

Figure 1:
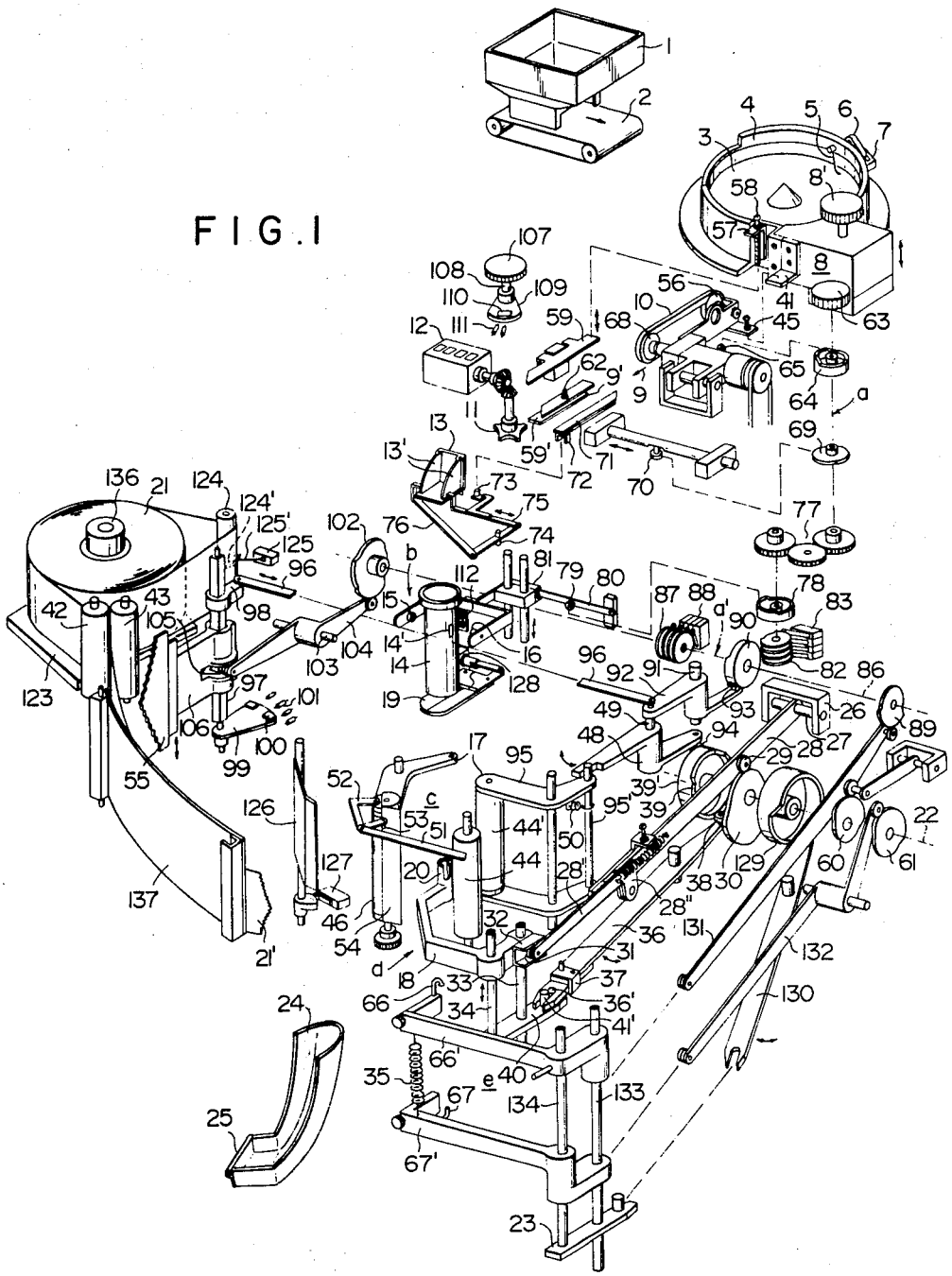
FIG. 1 is a fragmentary perspective view showing the entire structure of the coin packaging machine.

FIG. 1 is a perspective view illustrating the entire structure of a coin packaging machine. When coins to be treated are thrown into a hopper 1, they are fed to a rotary disc 3 by a conveyor belt 2. By the rotation force of the rotary disc 3, the coins are pressed to a circular side wall 4 and aligned in this stage. The coins are thus delivered in the direction of rotation. When a sufficient number of the coins are aligned and piled at this point, a detecting lever 5 is lifted up by the accummulated coins to bring up a weight 6 disposed outside the side wall 4 and put off a switch 7 to stop a motor (not shown) for driving the conveyor belt 2. Accordingly, the supply of the coins is interrupted. Thus, appropriate quantities of coins are always supplied to the rotary disc 3 automatically. The aligned coins are taken in one by one from a gap of a gap regulating block 8 adjusted by a gap setting member 8' disposed adjacent to the rotary disc 3 in the coin kind setting mechanism a and fed to a coin passage 9. The coins are delivered astride of narrow selection rails 9' disposed on both the sides of the coin passage 9 while being pressed by a delivery belt 10. At this point, different coins of a shorter diameter cannot be supported astride the rails 9' but fall down into a discharge opening (not shown) formed in the lower portion and stored in a separate part. It should be noted that the selection mechanism described here is mentioned only by way of example and the coin packaging mechanism according to the present invention is not limited one employing the above-mentioned selection mechanism.

The coins being delivered along the coin passage 9 bear against a star gear 11, and every time one coin passes through the star gear 11, the star gear is rotated by one tooth and in this manner, the number of the coins is counted and the number is displayed by a displaying counter 12. Separately counting is performed by a counting device (not shown) and when a predetermined number is counted, counting is stopped and a signal is emitted.

The counted coins are guided to a chute 13 and fall down into an accumulating cylinder 14. A predetermined number of coins are horizontally accumulated and this state is inspected through holes 14' through the sides of the accumulating cylinder 14 by an irregularity detecting mechanism b comprising a light projector 15 and a light receiver 16. When the coins are correctly accumulated, a bottom shutter 19 is opened and the accumulated coins are placed on the top face of a supporting rod 20 mounted on the top end of a delivery lever 18 of a delivery mechanism d which has risen up and stands by for the delivery operation. Then, the delivery 18 is brought down and the coins are delivered to a packaging mechanism c.

Figure 2:
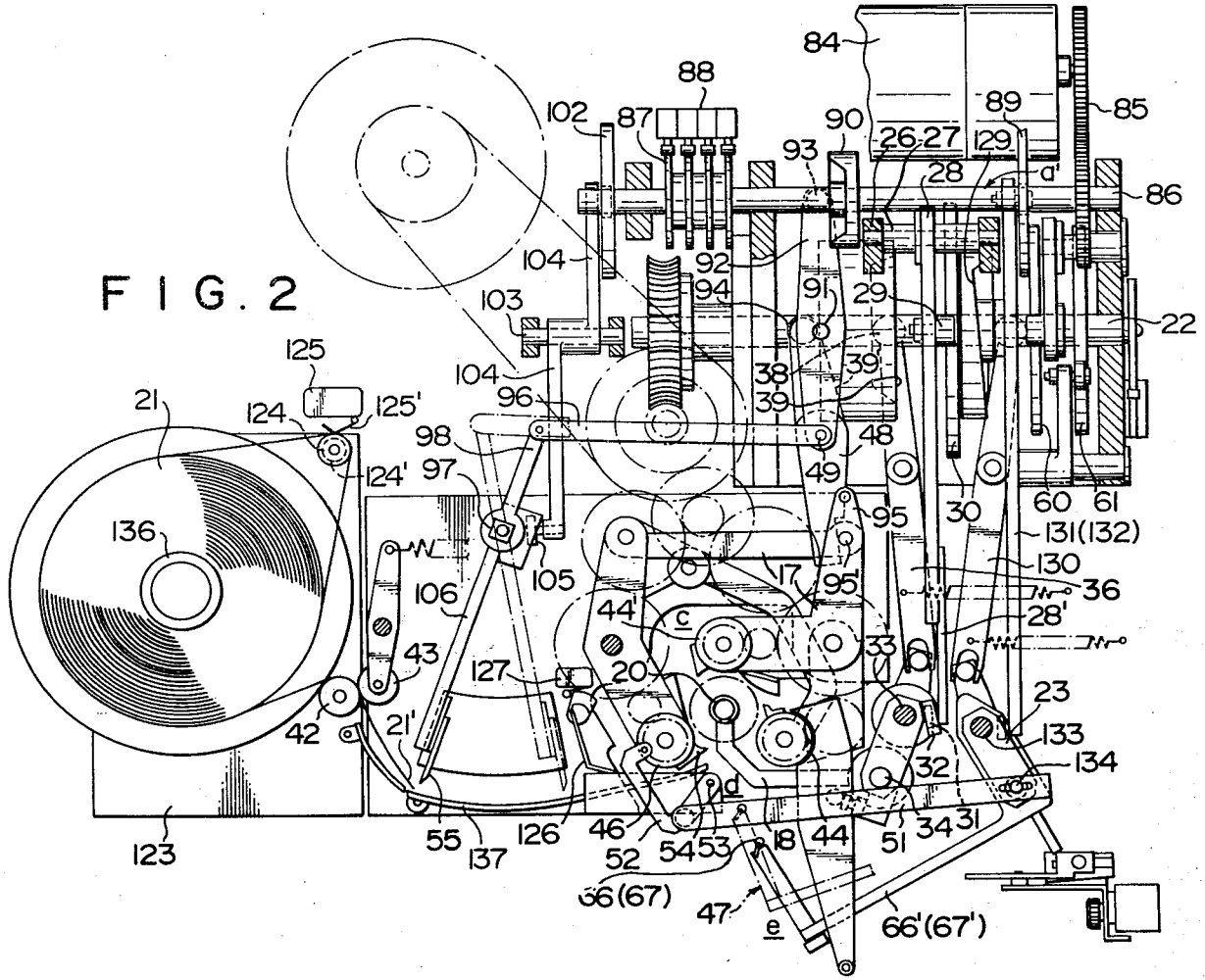
FIG. 2 is a plan view showing the packaging mechanism.

If the coins are not correctly accumulated horizontally in the accumulating cylinder 14, the height of the accumulated coins is increased so that the coins intercept the light from the projector 15 and the irregular accumulation is detected. In this case, even if the delivery lever 18 rises up for receipt of the accumulated coins, the shutter 19 is not opened and a packaging paper 21 is not fed out. Further, a driving motor described hereinafter with reference to FIG. 2 is rotated in the reverse direction to rotate a cam shaft 22 or the packaging mechanism c in a reverse direction, and the delivery lever 18 is returned to the original predetermined position and stands by at this position. Substantially at the same time, the shutter 19 is opened and the coins in the accumulating cylinder 14 allowed to fall in the irregular state, and they are blocked by closing of a gate 25 mounted on the top end of a roll chute 24 and operated by a linking mechanism or electromagnetic device or they are stored in a separate part by opening of the gate 25. Thus, the operation of the machine is stopped.

The operation of the delivery mechanism d will now be described.

A vertical operation lever 28 is supported on a shaft 27 piercing through a bracket 26, and a cam follower 29 is rotatably mounted at an intermediate part of the lever 28 and is engaged with a cam 30 of the cam shaft 22. The cam follower 29 is always pressed onto the cam 30 by a spring (not shown).

A roller 31 is rotatably attached to the top end of the vertical operation lever 28 and is engaged with a guide 32 of the delivery lever 18 to move up and down on vertical shaft 33 and guide shaft 34 mounted on a receiving plate 40 along a predetermined cam curve.

The front portion 28' of the vertical operation lever 28 is provided with a bendable device 28'' for being bent only downwardly so that no abnormal force is imposed at the failure of the packing operation of other time. A horizontal operation lever 36 acting in the horizontal direction is disposed to move and retract the delivery mechanism d to and from the central position of the packing mechanism c and a forked engaging groove 36' is formed on one end of the lever 36. The lever 36 is arranged so that it is bent in one direction on the horizontal plane from an intermediate bent portion 37. A cam follower 38 is rotatably attached to the other end of the lever 36 and the cam follower 38 bears against a face cam 39. Since a pin 41' of the receiving plate 40 disposed in the lower portion of the delivery mechanism d is engaged with the forked engaging groove 36', the movement of the delivery mechanism d about an upright shaft 33 in the horizontal direction is regulated by the curve of the face cam 39.

Substantially at the same time the accumulated coins are delivered to the packaging position of the packaging mechanism c by the supporting rod 20 of the delivery mechanism d, a clamping mechanism e retreats in a direction further apart from the packaging mechanism c. Accordingly, a linking lever 52 connected to a linking lever 51 connected to the clamping mechanism e is operated with a pin 53 acting as the center, and hence, a paper guide plate 54 rotatably mounted coaxially with a packaging roller 46 is rotated in a direction approaching the accumulated coins to block the gap between the packaging rollers 46 and 44 and prevent the collapse of the accumulated coins. In the ordinary state, this gap is kept in the free state because the delivery lever 18 or clamping arm 66' or 67' inserted in this gap. It is possible to adopt a modification in which this gap is especially broadened for facilitating insertion of the delivery lever 18 or the clamping arms 66' and 67' and the collapse of the accumulated coins is prevented by the paper guide plate 54.

Then, the top end 21' of the packaging paper 21 fed out by rotation of paper feed rollers 42 and 43 intrudes into the gap between the packaging roller 44 and the accumulated coins and an opening and closing lever 48 operated by a face cam 39' on the back side of the face cam 39 is turned with a shaft 49 acting as a fulcrum. At this point, three packaging rollers 44, 44' and 46 are simultaneously moved toward the center through a link member 17 by the tensile force of a spring 50 to press and grip the peripheral faces of the accumulated coins, and the packaging paper 21 is wound around the peripheries of the accumulated coins by rotation of the packaging rollers 44, 44' and 46. When an appropriate quantity of the packaging paper 21 is wound, the slack is removed from the packaging paper 21 because of the difference of the speed between the paper feed rollers 42 and 43 and the packaging rollers 44, 44' and 46, and the stretched paper 21 is pressed to a cutter 55, cut by the cutter 55 and wound up.

Then, the clamping mechanism e is turned and brought close to the packaging mechanism c by an operation lever 130 engaged at one end thereof with a face cam 129 of the cam shaft 22, and the paper guide plate 54 is retracted through connecting rods 51 and 52 associated with the clamping mechanism e in the opposite direction so that it is separated from the accumulated coins. The upper and lower clamping arms 66' and 67' and the clamping claws 66 and 67 are brought into contact with the accumulated coins through the packaging paper 21.

When the top ends of operation levers 131 and 132 engaged with plate cams 60 and 61 on the cam shaft 22 are engaged with the lower face and upper face of the upper and lower clamping arms 66' and 67', respectively, the upper clamping arm 66' is brought down by a stored force of a spring 35 while being guided by vertical shaft 133 and guide shaft 134 on the receiving plate 23, and the lower clamping arm 67' is lifted up by the same spring 35, whereby both the upper and lower edges of the packaging paper wound in the form of a cylinder are inwardly bent and clamped by both the clamping claws 66 and 67. When this clamping operation is almost completed, the delivery lever 18 is caused to move away in the horizontal direction from the position for supporting the accumulating coins, after the supporting rod 20 is separated in the vertical direction from the accumulated coins. The supporting rod 20 is then retracted outwardly and stands by at the retracted position.

When the clamping operation by the clamping claws 66 and 67 is completed, the cams 60, 61 and the upper and lower operation levers 131 and 132 is lifted up and the upper clamping arm 67' is brought down, and they are separated from the accumulated coins, are turned about the upright shaft 133 in the horizontal direction to separate from the packaging mechanism c and stand by at the first stage retreat position 47 (see FIG. 2). This stand-by position 47 of the clamping mechanism e is set so that the paper guide 54 can be opened by the connecting rod 51 and the gap between the paper guide plate 54 and the packaging roller 44 is sufficient to guide the accumulated coins downwardly to the packaging mechanism e.

The packaging rollers 44, 44' and 46 of the packaging mechanism c release the accumulated coins from the gripping action and the accumulated coins fall down into the roll chute 24 located below and once topped by the gate 25 on the top end of the chute 24. The gate 25 is opened with appropriate timing by a cam mounted on the cam shaft 22 or an electromagnetic device (not shown) and the coins are stored in a box or the like.

The operation on selection or change of the kind of coins to be treated will now be described. Incidentally, the one-dot chain line in FIG. 1 indicates a direct or indirect transmission system.

According to the thickness of coins to be treated, a gap setting member 8', for example, a handle, is operated to bring up or down a gap regulating block 8 so that the gap between the block 8 and the rotary disc 3 is set in agreement with the thickness of the coins. Also a feed arm 45 engaged with the top face of an L-shaped fitting 41 fixed to the block 8 is brought up or down to determine the height of a feed pulley 56 located on the side of the rotary disc 3 so as to be suitable for the thickness of the coins so that an appropriate bite-in condition can be attained in the coins which are fed one by one.

A gap regulating plate 59 on the side of the coin passage 9, which is anchored by an adjusting screw mounted on a reverse L-shaped fitting 57 fixed to the top end of the block 8, is always pushed upwardly by a vompression spring 62 and therefore, the gap of the coin passage 9 is determined simultaneously with positioning of the block 8.

Then, a coin kind setting member 63, for example, a handle, of the coin kind setting mechanism a is operated according to the kind of the coins to be treated. At this point, the gap between the other feed pulley 68 and the coin passage 9 is determined by a roller 65 engaged with an adjusting cam 64, and a movable reference plate 71 is displaced relative to a fixed reference plate 59' so that the width of the coin passage 9 is determined according to the diameter of the coins to be treated by means of a roller 70 engaged with a diameter cam 69.

By a pin 73 engaged with an engaging plate 72 fixed to a standard plate 71 constituting the coin passage 9 on the movable side thereof, the distance between both the left and right side walls 13' of the chute 13 connected to operation levers 75 and 76 co-operating with a shaft 74 acting as the center is adjusted so that a guide passage to the accumulating cylinder 14 is formed according to the diameter of the coins to be treated.

The irregularity detecting mechanism b is adjusted concerning an aperture 14' of the accumulating cylinder 14 replaceable in accordance with the coin kind so that the height of the accumulated coins is adjusted by an irregularity detecting cam 78 turned through gears 77. More specifically, by a sliding block 81 operated by a lever 80 to which a roller 79 engaged with the irregularity detecting cam 78 is fixed, the positions of the light projector 15 and light receiver 16 are determined in agreement with through holes 14' formed on the accumulating cylinder 14 in the diameter direction thereof.

Figure 4:
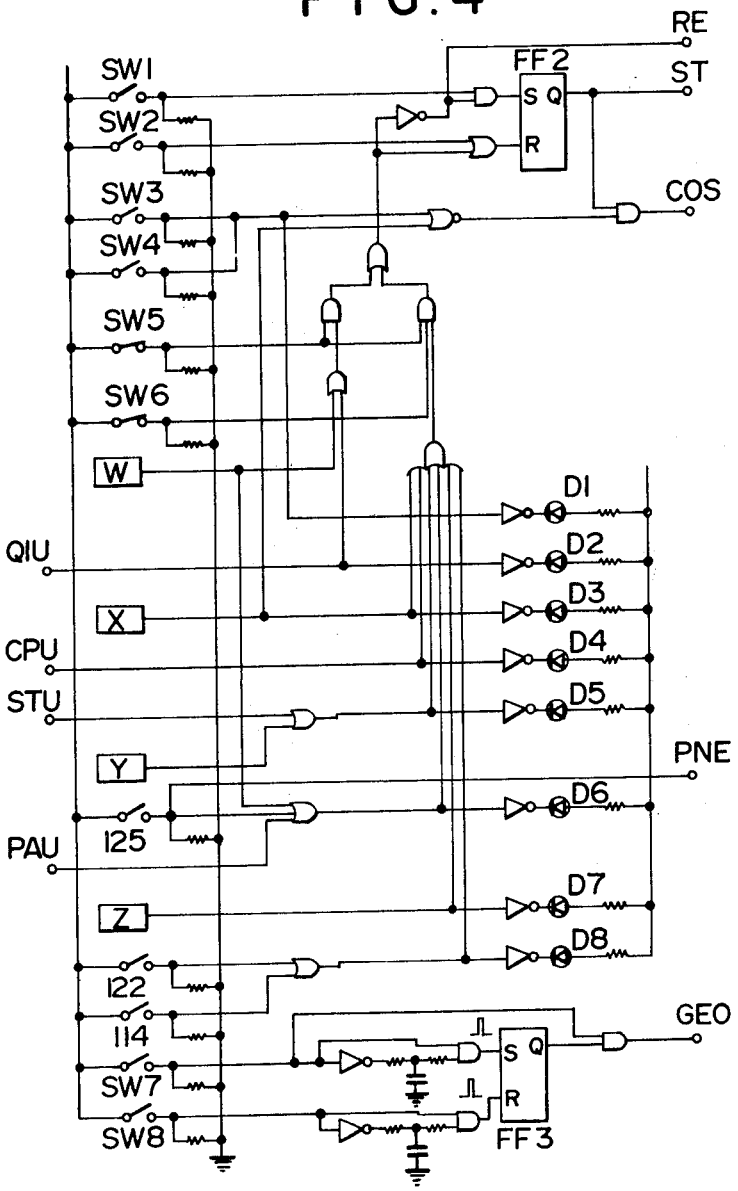

Four selection switch cams 82 are disposed coaxially with the irregularity detecting cam 78 and by selecting an appropriate combination in their contacts with four corresponding selection switches 83, the kind of the coins to be selected is selected, and a setting motor 84 shown in FIGS. 2 and 4 starts rotation and a setting shaft 86 in an adjusting mechanism a' is rotated co-operatively with a driving gear 85 attached to the shaft of the motor 84. When a combination of contacts selected between four setting switch cams 87 and four corresponding switches 88 is in agreement with the above-mentioned combination of the contacts of the selecting switches 83, the rotation of the setting motor 84 is stopped to set the selected angular position of the setting shaft 86.

By an initial position setting cam 89 counted on the setting shaft 86, the height of the initial position for starting the clamping operation of the upper clamping claw 66 is determined according to the height of the accumulated coins.

By an open position setting cam 90 mounted on the setting shaft 86 to determine the open gap among the respective packaging rollers 44, 44' and 46, the positions of these rollers 44, 44' and 46 are set according to the diameter of the coins to be treated so that a gap slightly larger than the diameter of the coins is provided and the accumulated coins are smoothly and safely advanced when they are introduced. More specifically, a roller 93 mounted on one end of setting lever 92 turning with a shaft 91 acting as the center is engaged with the open position setting cam 90, and a shaft 49 is fixed to the other end of the lever 92 and an opening and closing lever 48 is disposed so that it can turn with the shaft 49 acting as the center. A roller 94 mounted on one end of the opening and closing lever 48 is engaged with the face cam 39' and the other end of the lever 48 is engaged with a shaft 95' piercing through an arm 95 of the link member 47 supporting the packaging roller 44'. Accordingly, when the face cam 39' is rotated, the packaging rollers 44', 44 and 46 are contracted from the open positions through the link member 17 and the arm 95 along the cam curve of the face cam 39' and operated by a predetermined quantity in the direction supporting and gripping the coins. Since a linking rod 96 is connected to the same end portion of the setting lever 92 is connected to a lever 98 mounted on a cutter shaft 97, the rod 96 is turned co-operatively with the setting of the packaging mechanism c according to the diameter of the coins and the cutting position of a cutter 55 is automatically set according to the required length of the packaging paper 21. At this point, a magnet attachment plate 99 mounted below the cutter shaft 77 is simultaneously turned and by a magnet 100 disposed in the vicinity of the periphery of the plate 99, a predetermined switch among several switches 101 is actuated to set the feed length of the packaging paper 21 according to the diameter of the coins. When the cutting position of the cutter 55 is manually set, these switches 101 can be used as reference switches for preventing nonperformance of setting or mis-setting.

The operation of a cutter cam 102 mounted on the setting shaft 86 will now be described. Since the cutter cam 102 has already been set at the selected position as mentioned above, an operation lever 104 having one end contacted with the cutter cam 102 is turned with a shaft 103 acting as the center, and a holding arm 106 of the cutter 55 is engaged with a roller 105 mounted on the other end of the operation lever 104 and is brought up to a center position corresponding to the height of the accumulated coins according to the predetermined cam curve of the cutter cam 102. Accordingly, the cutter 55 mounted on the top end of the holding arm 106 is automatically arranged so that the cutting center of the cutter 55 agrees with the center of the packaging paper 21 with respect to the widthwise direction irrespective of the width of the cutting paper 21.

Setting of the number of coins to be packaged will now be described.

The number of coins to be packaged varies according to the kind of coins. For example, 20, 40 or 50 coins are packaged. Therefore, if the number of coins to be packaged is not preliminarily selected according to the kind of coins to be treated, the clamping margin of the packaging paper 21 becomes insufficient or excessive depending on the accumulation height of the coins and the packaging operation ends in failure. Accordingly, in the present invention, when a certain coin kind is selected by the coin kind setting member 63, the machine is adopted not be operated until the coin number predetermined according to this kind is properly set. When a handle of a number setting member 107 is operated so that the predetermined number is set in a counting device (not shown) (electronic or mechanical counting device), the contact of any of two switches 111 (the number of switches is not critical but optional) is actuated by a magnet 110 attached in the vicinity of a lever 109 mounted on a shaft 108 to compare the combination of contacts among the selection switches 83 with the contact selected in the switches 111, and if the contacts are properly arranged, the operation of the machine becomes possible for the first time as hereinafter described in more detail.

Selection, attachment, dismounting and exchange of the accumulating cylinder 14 will now be described.

When the kind of coins to be treated is changed, also with the accumulating cylinder 14 is exchanged with one conforming with the diameter of coins to be treated and is set at a predetermined position. The inner diameter of the accumulating cylinder 14 is determined according to the diameter of the coins. Accordingly, if exchange of the accumulating cylinder 14 is forgotten, an accumulating cylinder not compatible with the coin kind is set or if no accumulating cylinder 14 is set inplace, coins are held up or they are not accumulated in good conditions, and therefore, scattering of the coins in the machine is caused. Accordingly, a detecting device is disposed to detect such trouble.

At the irregulating detecting mechanism b, a plurality of detecting switches 112 (four switches in the embodiment shown in the drawing) are disposed to confront the accumulating cylinder 14, and one or a plurality of operation pieces (not shown) are disposed on the back side of the accumulating cylinder 14 to confront any of the switches 112.

Accordingly, if any contact of the selection switches 83 co-operating with the coin kind setting member 63 is appropriately combined with any contact of the detecting switches 112, it is seen that the correct accumulating cylinder 14 is set, and the operation of the machine becomes possible. When it is detected that a proper accumulating cylinder is not set, an alarm is given and the operation of the machine is prevented.

The operation of feeding out the packaging paper 21 and other operations will now be described.

The packaging paper 21 is charged or fitted on a metal core of the charging table or stand 123 which can be pulled out of the coin packaging machine or is removably mounted on the coin packaging machine. The charging table 123 is provided with an idle roller 124 and a paper feed roller 42 (also seen in FIG. 2). The packaging paper 21 is guided through the idle roller 124 along the paper feed roller 42 and then the charging table is inserted in the machine so that the packaging paper is sandwiched between the paper feed roller 42 and 43 and the leading end of the packaging paper is set to be guided along a lead plate 137. Provided opposite to the idle roller 124 is a packaging paper switch or a near end switch 125, an acutator 125' of which is adopted to engage with the idle roller 124 through the packaging paper 21. Although it is preferable that in the above-mentioned construction, when all the packaging paper has been consumed, the switch 125 is operated by the actuation of its actuator 125' to let an operator know of the absence of the packaging paper, the packaging paper switch 125 may be constructed so that it is operated by the removal of the charging stand 123. The idle roller 124 may be provided at its periphery with a groove 124' opposite to the actuater 125' to ensure that the packaging paper switch 125 is operated when the packaging paper 21 is absent.

Further, a paper cutting detecting plate 126 is also provided for actuating a paper cutting detecting switch 127 at the cutting time, Further, a solenoid 128 is also provided for opening the shutter 19, when energized, so as to support accumulated coins on the supporting rod 20.

Figure 3:
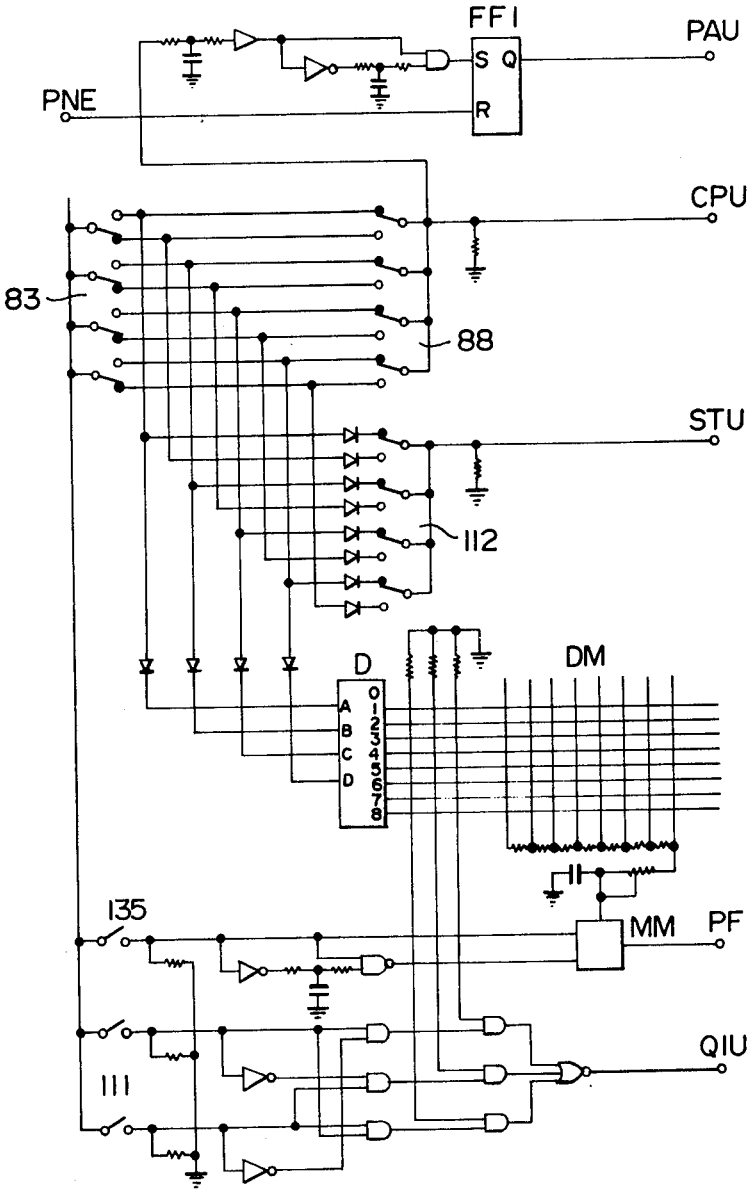
FIGS. 3 and 4 are wiring diagrams illustrating an embodiment of the electric circuit of the apparatus of the present invention.

An embodiment of the electric system that is used in the apparatus of the present invention will now be described by reference to FIGS. 3 and 4.

As the kind of the coins being packaged is changed by rotating the coin kind setting member 63, predetermined cams of the selection cams 82 actuate certain ones of the selection switches 83 to rotate the shaft of the motor 84. The rotation of the shaft of the motor 84 causes the setting shaft 86 to rotate through the driving gear 85 and then the setting shaft 86 is stopped in a predetermined angular position when predetermined cams of the setting switch cams 87 corresponds to the setting switches 88. Since the selection swtiches 83 do not correspond to the setting switches 86 until the setting shaft 86 is stopped, a non-conformity signal is put in a memory such as the set terminal of a flip-flop FF1.

The non-conformity signal set in the flip-flop FF1 turns on a light emitting diode D6 through a gate to let an operator know of the non-conformity of the packaging paper. Then, as the charging stand 123 is pulled out of the machine, the packaging paper switch 125 is operated. The operation of the packaging paper 125 causes a signal for indicating the pulling out of the charging stand 123 or the absence of the packaging paper to be issued at a terminal PNE. The signal issued at the terminal PNE is put in the reset terminal of the flip-flop FF1. Although the input from the flip-flop FF1 to the diode D6 disappears, the input from the packaging paper switch 125 is put in the diode D6 and, therefore, the diode D6 continous to emit light. Thereafter, when the charging stand 123 is checked and is returned to be mounted in the machine after replacement of the packaging paper, the packaging paper switch 125 is operated to be returned to an initial state so as to eliminate the non-conformity signal by turning the diode D6 off. Now the machine is ready for operation.

Thus, whenever the coin kind is changed by the coin kind setting member 63, the check for the packaging paper charged in the charging stand 123 is required and unless the charging stand 123 is again mounted within the machine, the machine cannot be started. Therefore, the coins will not be packaged with an unsuitable packaging paper of different size.

An additional explanation will be made with reference to FIGS. 3 and 4.

Until the setting shaft 86 is rotated in the predetermined angular position in which the selection switches 83 correspond to the setting switches 88, non-correspondence signal is issued at a terminal CPU to turn a light emitting diode D4 on. When the setting shaft 86 is stopped in the predetermined angular position, the diode D4 is turned off.

By non-conformity in the correspondence between the detecting switches 112 of the accumulating cylinder 14 and the selection signals 83, an accumulating signal non-conformity signal appears at a terminal STU to actuate a light emitting diode D5, and it is seen that the accumulating cylinder 14 is erroneously attached. Therefore, when the accumulating cylinder 14 is replaced in accordance with the coin kind, the diode D5 is turned off. These coin kind selecting signals are put in a diode matrix DM though a decorder D and further transmitted to a mono-multivibrator MM together with a signal of the paper feed switch 135 (see FIG. 3) to be actuated by the paper feed cam (not shown) rotated by the packaging cam shaft 22 which is rotated by one revolution per one operation. When the rotation quantity is equal in the paper feed rollers 42 and 43, a delay signal actuating a clutch device (not shown) to impart an appropriate quantity of rotation to the rollers 42 and 43 is given to a terminal PF, and the length off the packaging paper corresponding to the coin kind is set by the coin kind selecting switches.

When switches 111 for setting the number of the coins to be packaged to, for example 20 or 50, are not in conformity with switches selected in the selection switches 83, a coin number non-conformity signal appears at a QIU terminal to actuate a light emitting diode D2, and it is seen that inspection of the number of coins to be packaged is necessary. Therefore, when the correction is made, the diode D2 is turned off.

SW2 stands for a manual switch for emergency stop, and SW3 and SW4 are door switches disposed in the counting zone and packaging zone, respectively. These door switches are automatically closed when the doors are completely shut. When shutting of the doors is incomplete, a light emitting diode D1 is actuated and incomplete shutting is indicated.

SW5 stands for packaging counter switching switch and SW6 stands for a switch for operating a one-revolution or a one-rotation cam (not shown) attached to the cam shaft 22 and a one-rotation stop switch (not shown for said cam. W stands for a circuit for paper cutting detection including the paper cutting detection switch 127. X stands for a coin feed detecting circuit disposed in the vicinity of the star gear 11 in the coin passage 9 to detect the feed state of coins. When the coin feed state is not proper, a light emitting diode D3 is actuated and it is seen that inspection of the coin feed state is necessary.

An irregularity detecting circuit Y is disposed in the irregularity detecting mechanism b so that the state where the coins are not correctly piled but are accumulated, for example, in a slanted manner is detected through the light projector 15 and light receiver 16. The irregularity is indicated by the actuation of a light emitting diode D5.

A timing detecting circuit Z is disposed so that when the above-mentioned one-rotation operation is not accurately performed in the cam shaft 22, a light emitting diode D7 is actuated. The switch 122 is a surplus-and-short-packaging-number detection switch for detecting a surplus or short number of the packaged coins in which a set position suitable for the coins to be packaged is detected. In the event that a incorrected set position is detected, the switch 122 actuates a light emitting diode D8 through a gate. A switch 114 detects the number of the packaged coins during packaging operation to actuate the diode D8.

The foregoing switches 114 and 122, timing detecting circuit Z, near end switch 125, irregularity detecting circuit Y, terminals STU, CPU and QIU, coin feed detecting circuit X, paper cutting detecting circuit W and switches SW5 and SW6 are connected to the start output ST through respective gates and flip-flop FF2. Accordingly, when any one of the diode D1 to D8 is actuated, the flip-flop FF2 is set. When all of the diodes D1 to D8 are not actuated, the flip-flop FF2 is reset. Simultaneously when a signal is transmitted to the terminal RE to let an operator know that preparation for operation is completed, the start switch SW1 is closed to set the flip-flop FF2 and send the start output to the terminal ST the machine is started and a signal starting the counting circuit is transmitted to the terminal COS through a gate.

The timing switch SW7 is actuated by the cam of the cam shaft 22 and the shutter opening switch SW8 actuating the solenoid 128 for opening the shutter 19 put out a signal for opening the gate 25 to the terminal GEO through a flip-flop 3.

Switches 101 are disposed so that the cutter can be manually set. When the cutter is not correctly located at the cutter position corresponding to the coin kind selected by the coin kind selecting switches, a cutter position non-conformity signal is put out.

Even if the above-mentioned diode matrix is not used, the length of the packaging paper corresponding to the coin kind can be set by utilizing the switches 101 and the paper feed switch 135.

What is claimed is:

1. A packaging paper conforming device in a coin packaging machine which comprises a group of selection switches provided on a coin kind setting mechanism selectable by a coin kind setting operation in accordance with the kind of coin to be packaged, a group of setting switches provided on an adjustment mechanism set at a predetermined angle of rotation in accordance with relation between the selection switches and the setting switches and a packaging paper switch operable by the mounting and the removing of a removable charging stand, and in which non-conformity signal produced from the selection of the selection switches and the setting of the setting switches is put into and stored in a memory to indicate the non-conformity of the packaging paper and to disenable the operation of the machine, and the memory is reset through the packaging paper switch by the inspection of the packaging paper attendant on the removing and mounting of the charging stand to eliminate the non-conformity signal and to enable the operation of the machine.

* * * * *